US005769150A

United States Patent [19]

Fukuda

[11] Patent Number: 5,769,150

[45] Date of Patent: Jun. 23, 1998

[54] METHOD FOR FORMING HOLLOW CORE

[75] Inventor: Tokiharu Fukuda, Toyota, Japan

[73] Assignee: Toyota Jidosha Kabushiki Kaisha, Toyota, Japan

[21] Appl. No.: 727,989

[22] Filed: Oct. 10, 1996

[30] Foreign Application Priority Data

Oct. 13, 1995 [JP] Japan ..... 7-265669

[51] Int. Cl.[6] ..... B22C 9/10

[52] U.S. Cl. ..... 164/456; 164/21; 164/28

[58] Field of Search ..... 164/21, 22, 28, 164/228, 456

[56] References Cited

FOREIGN PATENT DOCUMENTS

| | | | |
|---|---|---|---|
| 57-50245 | 2/1982 | Japan | 164/228 |
| 1-157742 | 6/1989 | Japan | 164/28 |
| A-5-200489 | 8/1993 | Japan . | |
| Y2-5-30833 | 8/1993 | Japan . | |
| A-5-305386 | 11/1993 | Japan . | |
| B2-6-35028 | 5/1994 | Japan . | |

*Primary Examiner*—Kuang Y. Lin
*Attorney, Agent, or Firm*—Oliff & Berridge, PLC

[57] ABSTRACT

In order to prevent casting with an abnormal hollow core having partially thin wall or filled in parts, a new method suitable for forming good hollow core stably and suitable for checking the hollowness of the moulded core before casting is proposed. This method comprises a step of providing a filling hole and an air inlet hole in a mould for core formation, a step of filling the mould with core sand with the air inlet hole in a closed state, a step of heating the mould and a step of sucking out unhardened sand through the filling hole with the air inlet hole in an open state. Unhardened sand is sucked out with the air flow from the air inlet hole to the filling hole, and the hollowness of the core is checked by measuring the pressure at the filling hole.

4 Claims, 2 Drawing Sheets

METHOD FOR FORMING HOLLOW CORE

BACKGROUND OF THE INVENTION

1. Field of the Invention

The present invention relates to a method for forming a core that is used to cast a hollow casting by setting it in a casting die. In particular, this invention relates to a core forming method of a type wherein the core itself is hollow.

2. Description of the Prior Art

Hollow cores are starting to become widely used instead of solid cores since they have several advantages. Hollow cores, can make savings in the amount of sand or the like that is used to make the cores, are lightweight and easy to handle, and since they have little ability to cool the melt they are suitable for the casting of thin-walled castings. Various techniques have been proposed for forming hollow cores. For example, in the technique disclosed in Japanese Laid-Open Utility Model Application No. 5-30833, (i) sand intermixed with a thermosetting resin (referred to as "core sand") is filled from the sand inlet hole into a mould for forming a hollow core, (ii) the resin in contact with the mould is hardened by heating the mould to a specific temperature, (iii) unhardened core sand is sucked out from the sand inlet hole, and (iv) a hollow core is formed wherein only the outer layer is hardened and the core sand has been taken out from the interior. In the technique disclosed in Japanese Laid-Open Patent Application No. 6-35028, (i) a suction pipe is inserted beforehand into a mould for forming a core, (ii) core sand is filled into this mould, (iii) the core sand in contact with this mould is thermally hardened by heating the mould, forming an outer layer, (iv) the inside of the mould is pressurised with compressed air, and (v) the hollowed-out core is formed by sucking out the unhardened core sand through the said suction pipe while extracting this pipe from the mould.

The wall thickness of hollow cores formed in this way varies according to such factors as the time from the mould is filled with core sand until the unhardened core sand is sucked out (i.e., the heating time). Therefore, to judge variations in the wall thickness—that is, the hollowness of the core—the interrelationship between the weight and hollowness of the core is determined beforehand, and the actual measured weight is compared with the weight that should achieve a suitable hollowness. The checking of the hollowness is carried out based on the assumption that the wall thickness is likely to be too small if the actual measured weight is too small, and the wall thickness is likely to be too large if the actual measured weight is too large.

However, there are various problems with the above mentioned judging method. First, a problem with the formation technique is that the core sand is often not removed smoothly while sucking out the unhardened core sand, in which case the wall thickness distribution can easily become uneven. Also, a problem with the pass/fail judgement method is that if the wall thickness distribution is uneven, the wall thickness may be too small in some places and too large in if the weight is in the right range, and it is impossible to judge such defective cores as defects.

SUMMARY OF THE INVENTION

An object of the present invention is to make the wall thickness distribution even by arranging for the unhardened core sand to be smoothly sucked out in a short period of time. In our research of conventional formation techniques, the present inventors discovered that when sucking out the unhardened core sand, this unhardened core sand is surrounded by the mould or the hardened outer layer so that the circulation paths of the gas or air are not secured and thus the sucking out of the core sand does not proceed smoothly. We discovered that, as a result, the wall thickness is large in parts that are difficult to empty out, whereas the wall thickness is small in parts that are easy to empty out. In the present invention, flow paths are secured for the gas or air while sucking out the unhardened core sand, which is smoothly sucked out along with this flow of gas or air.

A further object of the present invention is to provide a highly reliable hollowness pass/fail judgement method. If the core sand is sucked out while introducing gas or air into the mould for core formation, the flow of gas or air during this suction is smoother when the wall thickness is smaller and the hollowness is larger, and the resistance is stronger when the wall thickness is larger and the hollowness is lower. If the degree of smoothness of this flow of gas is measured, it becomes possible to perform highly reliable pass/fail judgement of the degree of hollowness.

The present invention will be more fully understood by reading the following description with reference to the drawings.

DETAILED DESCRIPTION OF THE PREFERRED EMBODIMENT

A preferred embodiment of the present invention is described in the following.

Figure 1A:
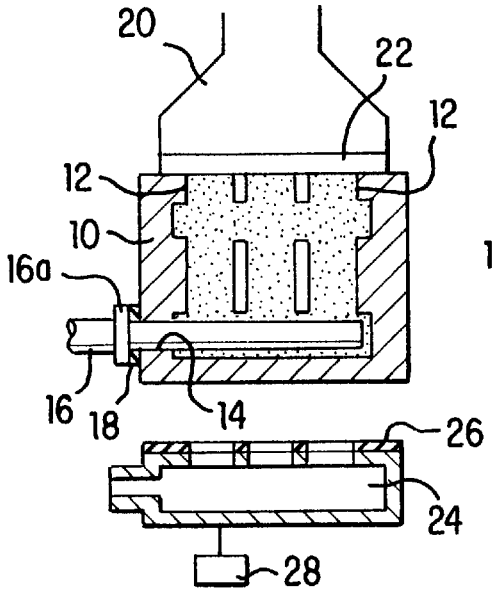
FIGS. 1(A) to (D) are explanatory views showing the formation process of a hollow core in one embodiment of the present invention.

FIGS. 1(A) to 1(D) are explanatory views showing the formation process of a hollow core. These drawings describe the formation method of hollow core 40. As shown in FIG. 1(A), a mandrel rod 16 which is used to hollow out thick part 40*a* of core 40 to be moulded in its interior is inserted into metal mould (core mould) 10 from hole 14 in the side wall. This mandrel rod 16 is provided with temperature-resistant sealant packing 18 for increasing the bonding between its flange 16*a* and the side wall of metal mould 10 and preventing leakage of sand from the hole 14.

Flow head 20 is then fastened to the upper surface of metal mould 10, and the core sand stored inside this flow head 20 is filled by blowing in from sand blowing-in hole 12 to the inside of metal mould 10. This flow head 20 is also provided with heat resistant sealant packing 22 to increase the bonding with the upper surface of metal mould 10 and to prevent the leakage of sand to the outside.

Figure 1B:
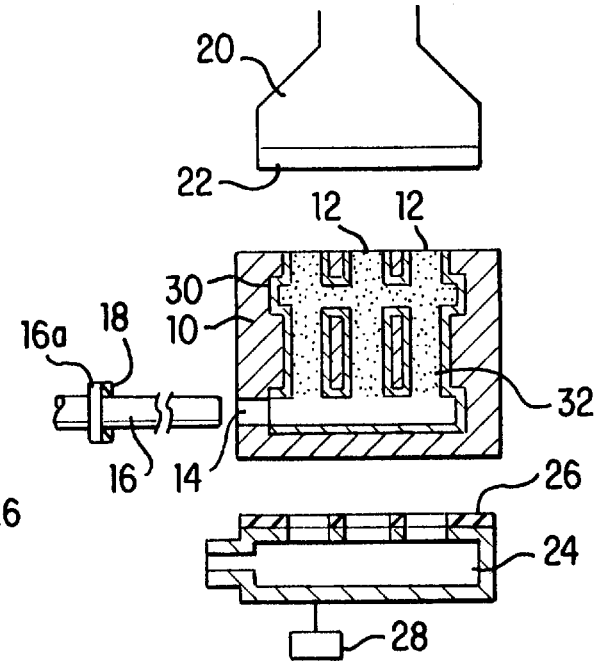

Next, as shown in FIG. 1(B), flow head 20 is raised up, and the mandrel rod 16 is completely extracted from the metal mould 10. Outer layer part 30 is then formed by heating metal mould 10 to heat up and harden the core sand in contact with metal mould 10. Thus, with the exception of this outer layer part 30, the core sand is left as unhardened core sand 32.

Figure 1C:
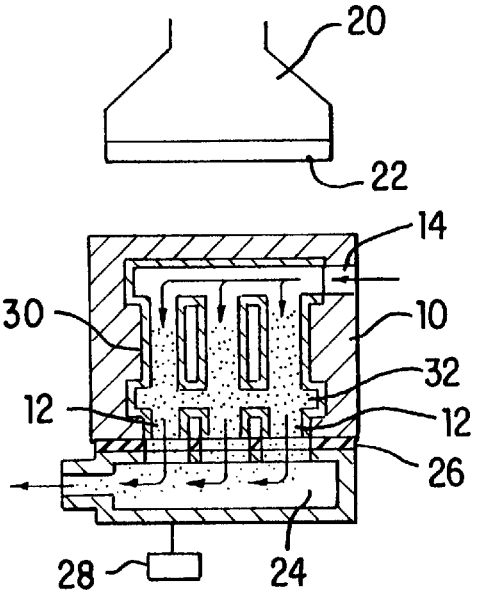

Next, as shown in FIG. 1(C), by turning metal mould 10 upside down, the unhardened core sand 32 is discharged from metal mould 10 through the sand blowing-in hole 12, which has become the lower side. At the same time, a suction tank. 24 connected to a suction device (not illustrated) is brought up and fastened to the lower surface of metal mould 10, and the unhardened core sand 32 inside metal mould 10 is sucked out by sucking through sand blowing-in hole 12 while introducing air from outside through hole 14 from which the mandrel rod 16 was extracted. The suction tank 24 is also provided with temperature resistant sealant packing 26 to increase the bonding with the lower surface of metal mould 10. The pressure inside suction tank 24 is measured by a pressure sensor 28 attached to this suction tank 24.

The regions in which unhardened core sand 32 existed communicate with the outside air via hole 14, and thus with the suction from suction tank 24, a flow of air is secured from hole 14 to suction tank 24 through the regions in which unhardened core sand 32 existed, and the unhardened core sand 32 is discharged in a short time regardless of the regions in which it exists. Note that the temperature of metal mould 10 is high even during suction, and the core sand in contact with metal core 10 continues to harden. Since the unhardened core sand 32 is sucked out in a short time regardless of the regions in which it exists, the thickness of outer layer part 30 is made uniform irrespective of position.

Figure 1D:
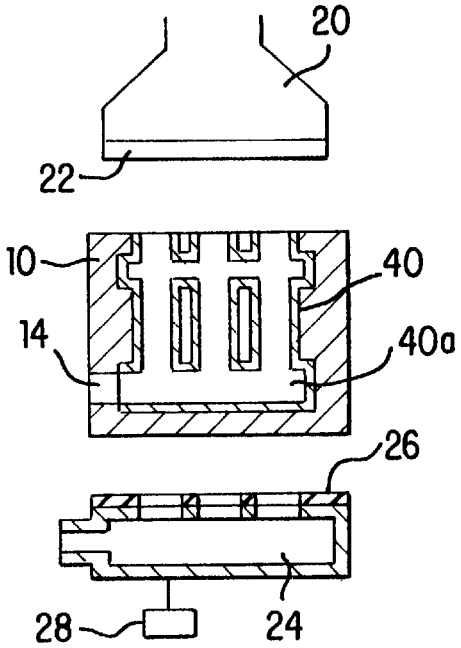

When the sucking of unhardened core sand 32 has been completed in this way, suction tank 24 is dropped down to its original position, metal mould 10 is rotated back into its original state, and the mould is then opened and the hollow core 40 formed inside it is taken out, whereby the core fabrication operation sequence is completed as shown in FIG. 1(D).

Figure 2:
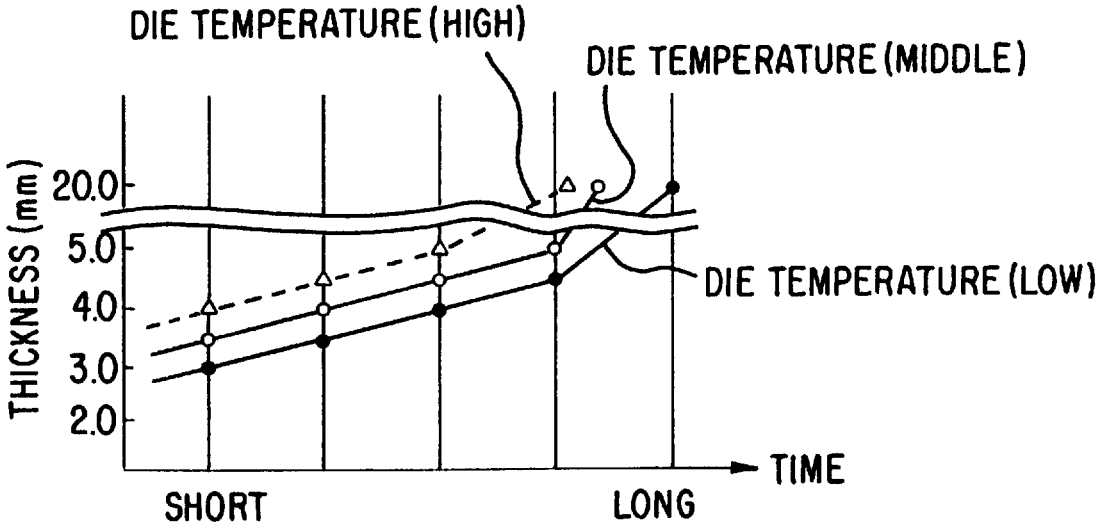
FIG. 2 is a characteristic chart showing the variation in wall thickness of a hollow core according to the elapsed time from the end of filling with core sand until the start of suction of unhardened core sand.

In the present embodiment, pass/fail judgement of the hollowness is performed in three ways. The first is to check whether or not the time between the completion of filling with core sand and the start of the sucking of unhardened core sand is within a predetermined time. FIG. 2 shows, for different heating temperatures of metal mould 10, the thickness variation of hollow core 40 with time T from the completion of filling with core sand until sucking out of unhardened core sand 32. In the mould formation process, the time is determined from the thickness of the outer layer of the core to be moulded and the temperature of the metal mould, and it is operated such that the unhardened core sand is sucked after this time has elapsed. However, when attempting to form a core in practice, the operations may not proceed as planned and the timing at which the core sand is sucked out may differ from the predetermined timing. In the present embodiment, an error is output when they are widely different, thereby preventing casting with defective hollow cores.

Figure 3:
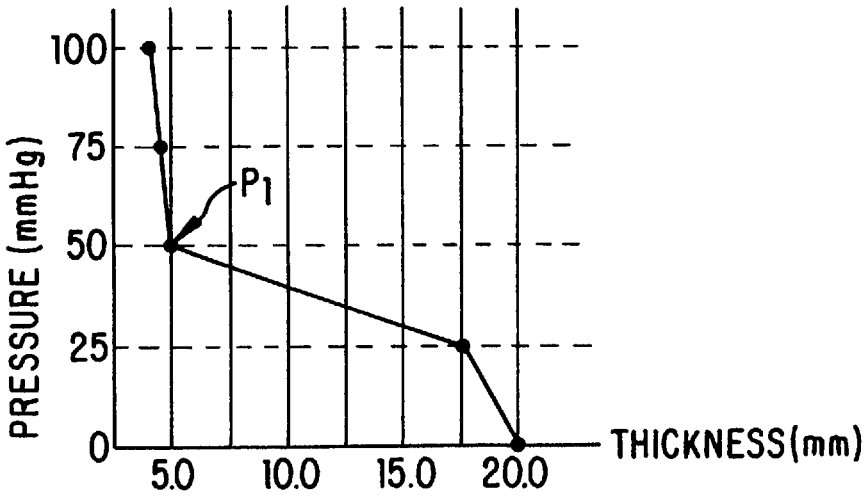
FIG. 3 is a characteristic chart showing the variation of the pressure at an unhardend sand suction hole according to the wall thickness of the hollow core.

The second check is to measure the resistance during suction. The resistance is measured from the pressure inside suction tank 24. When the thickness is small and the cross-sectional area of the hollow part is large, the pressure inside suction tank 24 is close to atmospheric pressure. On the other hand, when the thickness is large and the cross-sectional area of the hollow part is small, the pressure inside suction tank 24 is close to a vacuum. FIG. 3 shows the relationship between the thickness of the wall of the hollow core and the pressure inside suction tank 24. When the thickness exceeds 20 mm, the hollow part is filled in and the pressure inside tank 24 is equal to the pressure of the suction pump. When the thickness is 5 mm, the pressure inside tank 24 is 50 mmHg greater than the pressure of the suction pump. In the case of the present embodiment, the desired thickness is 5 mm. Thus, 50 mmHg is taken as the predetermined value P1 for the difference between the pressure inside the tank and the pressure inside the suction pump (suction pressure P), and the thickness is judged to be abnormally large if the measured value of suction pressure P is less than or equal to P1, and is judged to be completely suitable if it exceeds P1. For example, if the measured value of suction pressure P is 40 mmHg, it is estimated that the thickness of hollow core 40 has reached about 10.0 mm, which is thus judged to be an error in this case. Conversely, if the measured value of suction pressure P greatly exceeds the setting value P1 at 75 mmHg, it is estimated that the thickness of hollow core 40 is about 4.5 mm, and since this value is within the permissible range it is judged to be suitable.

The third check is to measure the weight of the resulting hollow core and to check whether or not it is within suitable limits.

A specific example of a sequence for judging the hollowness of hollow core 40 is as follows: first, the judgement is performed with regard to the time T from filling until sucking, and if this measured value is outside the range of predetermined value T1, an NG signal is outputted to a core taking-out device (not illustrated), whereas if the measured value is inside the range of predetermined value T1, it proceeds to the judgement process with regard to suction pressure P. Next, if the measured value of suction pressure P is less than or equal to the predetermined value P1, an NG signal is outputted to the core taking-out device, and if this measured value exceeds the predetermined value P1, it proceeds to the core weight judgement step. At the weight judgement step, the weight of hollow core 40 is measured and an OK signal is outputted to the core taking-out device if this measured value is in the range (+5%) of the estimated weight of a suitably produced hollow core 40. That is, even if the measured value of the time T from filling until sucking is in the range of the predetermined value T1, and the measured value of suction pressure P exceeds its predetermined value P1, an NG signal is outputted to the core taking-out device at the weight measurement step if, for example, outer layer part 30 has not formed due to a fault in the heating of the core sand.

If an NG signal is output at any of the judgement steps, there is an abnormality in the thickness of hollow core 40 (a partially thin part or filled-in part), and thus the defective core is discarded by, for example, turning over the core taking-out device based on the NG signals.

Note that, apart from special cases such as faults in the heating of the core sand, it is possible to judge the hollowness of hollow core 40 to a certain degree of precision by a comparative judgement with regard to the said suction pressure P.

The form of an embodiment of the present invention has been described above, but it is further noted that the form of this embodiment includes in particular the following technical items.

(1) The time from the completion of filling with core sand until the start of suction of the unhardened core sand is preset based on the required thickness of the core, and the thickness of the core is judged by comparing the measured value of this time from filling of sand until the start of suction with its predetermined value.

In this way, the hollowness of the hollow core can be judged with greater accuracy. (2) After judging the thickness of the core by comparing the measured value and setting value of the suction pressure, the weight of the hollow core is measured and the thickness of the core is judged by comparing this measured value with the estimated weight value of a correctly formed hollow core.

In this way, it is also possible to detect formation irregularities due to faulty heating of the core sand and the like.

With the present invention, the hollowness of the core can be accurately measured, and it is possible to avoid circumstances such as the use of abnormal moulds without modification for moulding.

As apparent from the above description, the sand blowing-in hole 12 is used as a filling hole when a core sand filling space in the mould 10 is filled with the core sand. The hole 14 is used as an air or gas inlet hole when the unhardened core sand is sucked out through the flowing-in hole 12. The unhardened core sand is smoothly sucked out with the air flow from the air inlet hole to the filling hole and the wall thickness of the hollow core can be uniform. According to this method, hollowness of the core can be measured by the resistance of the air flow from the air inlet hole to the filling hole and the resistance is measured by the pressure at the filling hole when the unhardened sand is sucked out.

What is claimed is:

1. A method for forming a hollow core, comprising the steps of:

preparing a mould for core formation having a core sand filling space within the mould;

providing a filling hole and air inlet hole each connecting with said core sand filling space through said mould;

closing said air inlet hole;

filling said core sand filling space with core sand through said filling hole;

heating said mould filled with core sand;

opening said inlet hole;

sucking out the unhardened core sand filled in said space through said filling hole, whereby air is introduced into the space through said air inlet hole and sucked out through said filling hole;

measuring a pressure at said filling hole when the unhardened core sand is sucked out; and comparing the measured pressure with a predetermined pressure, whereby hollowness of the hollow core is checked while the core is within said mould.

2. A method for forming a hollow core according to claim 1, further comprising the steps of:

measuring the time from the start of core sand filling until the start of unhardend sand sucking; and comparing the measured time with a predetermined time, whereby hollowness of the hollow core is checked.

3. A method for forming a hollow core according to claim 1, further comprising the steps of:

measuring the weight of the moulded hollow core; and comparing the measured weight with a predetermined weight, whereby hollowness of the hollow core moulded is checked.

4. A method for forming a hollow core according to claim 1, wherein closing said air inlet hole further comprises inserting a mandrel rod into said air inlet hole.

* * * * *